United States Patent [19]

Puch

[11] 4,302,860

[45] Dec. 1, 1981

[54] FLOATING DEVICE FOR SWIMMING ACTIVITIES

[75] Inventor: Claude S. Puch, Noisy-le-Sec, France

[73] Assignee: Societe Meritor, Vanves, France

[21] Appl. No.: 98,964

[22] Filed: Nov. 30, 1979

[30] Foreign Application Priority Data

Dec. 7, 1978 [FR] France ..... 78 134454

[51] Int. Cl.[3] ..... A63C 9/08

[52] U.S. Cl. ..... 9/310 R

[58] Field of Search ..... 9/2 A, 11 R, 11 A, 310 B, 9/310 E, 310 R, 310 F, 310 G; 115/6.1, 70; 114/315, 270

[56] References Cited

U.S. PATENT DOCUMENTS

| | | | |
|---|---|---|---|
| 2,377,963 | 6/1945 | Rabjohn | 9/2 A |
| 2,685,696 | 8/1954 | Oscanyan | 9/11 A |
| 3,261,038 | 7/1966 | Klepper | 9/2 A |
| 3,490,085 | 1/1970 | Lewis | 9/11A |
| 3,628,206 | 12/1971 | Mecham | 9/11 A |

FOREIGN PATENT DOCUMENTS

| | | | |
|---|---|---|---|
| 2050890 | 4/1972 | Fed. Rep. of Germany | 9/310 E |
| 1026252 | 2/1953 | France | 9/11 A |
| 728592 | 12/1966 | Italy | 114/315 |

*Primary Examiner*—Trygve M. Blix
*Assistant Examiner*—Jesus D. Sotelo
*Attorney, Agent, or Firm*—Martin P. Hoffman; Mitchell B. Wasson

[57] ABSTRACT

A floating device, the upper or superior surface of which is designed to receive, support and at least partially protect the body surface of a swimmer lying chest-down on said device. A shell body is provided that protects, at least partially, the submerged surface of the device, as well as providing protection to other parts of the body of the swimmer, such as the arms and/or head or legs, most dangerously exposed to shocks/knocks against foreign bodies during the course of movement of the said device in the water. Further means are provided on said shell body, on the one hand in order to allow the swimmer to catch or hold himself on it, and on the other hand, eventually, to augment or increase the directional stability and steering of the device. The device is particularly adapted for use in sports activities and the descent of rivers and rapids.

6 Claims, 2 Drawing Figures

FLOATING DEVICE FOR SWIMMING ACTIVITIES

BACKGROUND OF THE INVENTION

The present invention relates to a floating device capable of being used by swimmers and divers equipped and protected in an adequate and correct manner, in order to descend or "run" rapids or fast rivers, by floating, in an athletic manner, with a minimum of danger, especially when these water courses are bristled or studded with obstacles such as large rocks, trunks or branches, or cut through by falls of relatively great differences in levels or gradients.

To attain the aforementioned objectives in the past, use has been made of inflatable/blown-up buoys or even air-filled inner tubes in round shape or form such as those used in tires of trucks. Nevertheless, the floating devices of such rudimentary and non-adapted/unembellished type present the following inconveniences/-disadvantages:

they are as unstable longitudinally as they are transversely;

they are effectively uncontrollable/unable to be guided/directed to slip through whirlpools/eddys of water between visible obstacles, or at a level with the water;

they are fragile and risk, as a result, of getting hung up/caught, or of having brutal encounters with roughness/rough water, resulting in the inevitable puncture for the remainder of the course;

they do not permit/allow sufficient contact with the body of the swimmer at the time of violent movements caused by the rough waters, falls, or quick changes of direction;

they do not permit a good, stable entry into the water following a rapids at the end of a falls; and finally, they are uncomfortable and sometimes even dangerous for the body of the swimmer who, insufficiently attached or protected, risks serious injuries.

It was not, therefore, readily evident in the prior art to construct a floating device having the requisite structural and functional characteristics to eliminate all the inconveniences enumerated above.

SUMMARY OF THE INVENTION

The object of the invention is the conception and the construction of a floating device which, in summary, is to be: stable, un-tippable, directionally controllable, strong and almost unpuncturable, fitting closely to the body of the swimmer, tractable or flexible to absorb shocks, comfortable yet offering great protection and security for user, and easily taken apart and deflated in order to be transported to different places of exercise or course.

Under these conditions and with these considerations in mind, the invention has for its primary objective a floating device of which the superior or upper surface is designed to receive, support and at least partially protect, the body surface of a swimmer lying chest-down on said device. This objective is achieved by the provision of a shell at least partially protecting the submerged or under surface of the device, as well as the other parts of the body of the swimmer, such as the arms and/or head or legs which are exposed most dangerously to shocks and bumps against foreign bodies and objects during the course of the movement of the device. Also, further means are provided on the body of said shell, on the one hand allowing the swimmer to secure himself thereto, and on the other hand, in order to increase the directional stability of the device.

Other objects and advantages will become apparent from a consideration of the description and of the claims which follow, which will be better understood when read or when construed in conjunction with the attached drawing forming a part of the description in which:

DETAILED DESCRIPTION OF THE INVENTION

Figure 1:
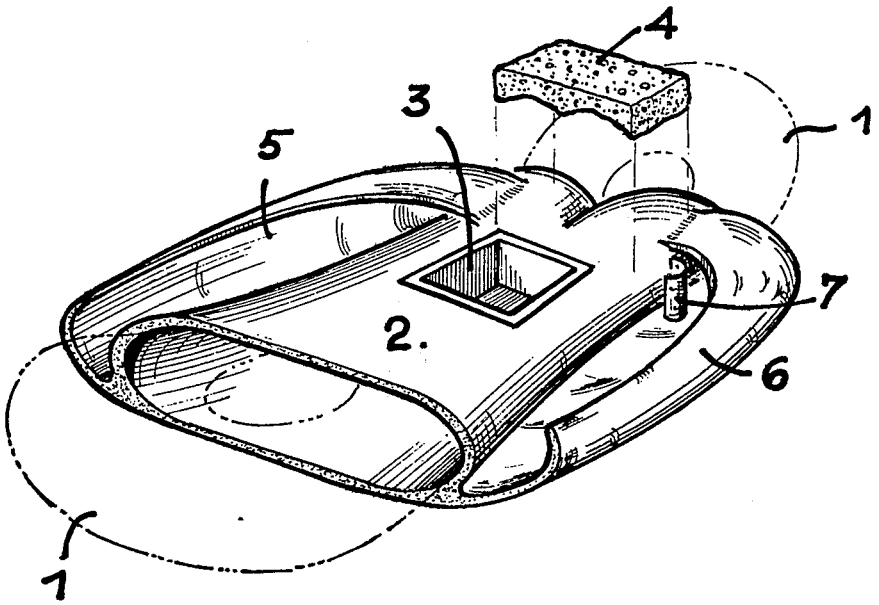
FIG. 1 is a perspective view of one embodiment of the invention.

In FIG. 1, the floating device according to the invention, comprises essentially the combination of an inflatable (preferably air-fillable) chamber of torus-shape 1, (shown by phantom lines), for example a truck tire inner tube, associated with a "hull" or body 2. The "hull" is an integral, unitary shell molded from a relatively rigid or stiff plastic material, but which is slightly deformable, playing the role of skeleton or frame, and providing reinforcement.

The chamber 1 could be replaced by elastic or springy inflatable tubes fitting into the hull body 2, while overflowing or extending slightly toward the front and the rear and also converging or joining toward the front.

These tubes could be non-inflatable floating elements, for example, made of a synthetic cellular material.

The suitably-shaped hull body has an opening into which the chamber 1 is introduced by force. In this way, it is made a part of the hull in a detachable manner. One would be able, therefore, to deflate it and to withdraw it from the hull body in order to transport it to the places where it will be used.

The chamber in the hull thus takes a generally elliptical, longitudinal shape overflowing toward the front and the rear, the rounded front part being more compressed than the rounded rear part.

The inferior or under surface of the hull body protects the tube 1 against rocks and other dangerous roughnesses encountered during the course of a descent. The body of the swimmer rests flat on the superior or upper surface of the device, simultaneously being in contact with the hull body on the one hand, and with the rounded rear part of the chamber on the other hand. The dimensions are such that the legs of the swimmer extend sufficiently toward the rear, in a manner to enable propulsion of the device if necessary, or to control/direct it, due to the conventional, webbed feet flippers which most underwater swimmers wear.

The shell body can have an opening or cavity 3 formed during molding. Likewise, in order for the swimmer's chin to rest comfortably on the hull body, one could interpose an absorption mattress or cushion 4, which is adhesively attached to the upper side of the hull body near the front.

The hull body can be entirely enclosed on the underside, as shown in FIG. 1. Alternatively, the hull body could be slightly open side to side, thus showing a longitudinally opening line; this configuration would provide greater flexibility or elasticity to the hull body.

One can easily understand, from the preceding discussion, that the head and legs of the swimmer are completely protected. Protecting the arms laterally, as well as the hands extending toward the front of the device, is described hereinafter.

In effect, the swimmer attaches himself to the device. Lateral sleeves 5 and 6, conveniently having a convex exterior surface for protecting the arms and hands of the swimmer, are forming during the molding of the hull body.

Hand-grasp elements by which the swimmer attaches himself or clings to the device comprise handles or grips 7.

Advantageously, but not necessarily, handles 7 are molded during fabrication of the hull body. The swimmer thus conforms or fits over well within the body of the device, in a comfortable and efficient way, and is completely secure. Due to the play of the flippers attached to the feet of the swimmer, his position allows the desired directional stability.

Figure 2:
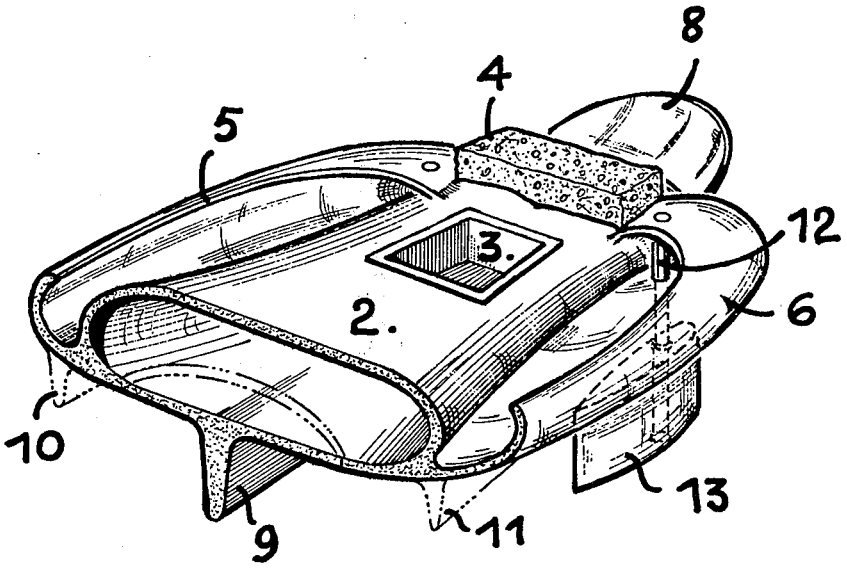
FIG. 2 is a similar perspective view of an alternate embodiment.

Shown in FIG. 2, the hull body has a bottom extended toward the front as a spatula or spoonshaped part 8 slightly rounded in an upwardly direction, for protecting the front of the floating chamber or the floats or tubes.

In order to increase the stability of the device and to facilitate its longitudinal directional displacement without dangerous skids, the underside of the hull body can be provided with either a keel or a stationary leeway point 9, or can be provided with fins 10 and 11 (shown in phantom lines), or both.

Finally, an even more sophisticated feature is providing gripping and stabilizing handles 12 which are manually rotatable. The handles are connected to directional, or steering, elements 13, which project under the protective sleeves 5 and 6.

Obviously, one could, without departing from the framework or scope of the present invention, realize diverse modifications to the form of the device that has just been described.

In particular, the molded hull body could assume forms other than those presented in FIG. 1 and FIG. 2, such modifications increasing the protection of the swimmer, the maintenance of the floating part of the device, per se, or the stability of the whole assembly. Other modifications of forms are envisioned that would further envelope the floating part, or even to enclose it entirely. One could also provide forms of hulls which could permit better hydrodynamic longitudinal displacement. One could even provide a unitary, integrally formed inflatable device which could be attached to the appropriate surfaces by gluing bands. More rigid sections could be utilized as the hull body.

Lastly, the described hull could be integrated with, or independent of, the floating device. The hull could be formed as a single part, or in several parts attached to each other by appropriate attaching means. The floating body is operatively associated with the different elements of the hull body and the protective parts.

Likewise, the plastic material of the hull body could be replaced by a metallic sheet, a laminated wood, or any compound of synthetic resins and other materials (for example, compounds used in the fabrication of skis).

Numerous other modifications will occur to the skilled artisan with out departing from the scope of the invention. Hence, the appended claims should be broadly construed and should not be limited to their literal terms.

What is claimed is:

1. A flexible floatatable device for transporting a swimmer through a dangerous water course, said device comprising:

(a) a relatively rigid hull comprising a lower surface that rides on top of the water, an upper surface adapted to receive a swimmer in a chest down position with the feet of the swimmer projecting beyond the rear edge of said hull, and a chamber defined between said upper and lower surfaces of said hull, (b) a relatively supple deformable member detachably secured within said chamber to provide a cushioning function for the hull and for the swimmer, (c) said deformable member comprising an inflatable tube that projects forwardly beyond the hull for providing a bumper at the forward end of the hull, (d) hand grips situated on said hull so that the swimmer can securely grasp same, and (e) means for protecting the arms and hands of a swimmer from obstacles situated in the water course while the swimmer grasps said hand grips.

2. A floating device as defined in claim 1 further comprising steering elements situated beneath the lower surface of said hull, said hand grips being connected to said steering elements so that the swimmer can manipulate said hand grips and operate said steering elements.

3. A floating device as defined in claim 1 wherein said means for protecting the arms and hands comprises spaced sleeves situated at the opposite lateral edges of said hull.

4. A floating device as defined in claim 3 wherein each sleeve has a convex exterior surface and is formed as an integral part of said hull.

5. A floating device as defined in claim 1 wherein said deformable member comprises a torus-shaped tube, said torus-shaped tube being inserted into said chamber in said hull prior to inflation and being retained therein in a protected manner by the hull.

6. A floating device as defined in claim 1 wherein said tube also projects rearwardly beyond the hull for providing a bumper at the rearward end of the hull.

* * * * *